US007990738B2

(12) United States Patent
Urrea et al.

(10) Patent No.: US 7,990,738 B2
(45) Date of Patent: Aug. 2, 2011

(54) MASTER FUSE MODULE

(75) Inventors: Julio Urrea, Chicago, IL (US); Greg Stumpo, Schaumburg, IL (US); Gary M. Bold, Palatine, IL (US); Heiko Froehlke, Ehrenburg (DE)

(73) Assignee: Littelfuse, Inc., Chicago, IL (US)

( * ) Notice: Subject to any disclaimer, the term of this patent is extended or adjusted under 35 U.S.C. 154(b) by 781 days.

(21) Appl. No.: 12/061,321

(22) Filed: Apr. 2, 2008

(65) Prior Publication Data

US 2009/0251200 A1 Oct. 8, 2009

(51) Int. Cl.
*H01H 85/20* (2006.01)

(52) U.S. Cl. ..... 361/833; 361/837; 439/620.27

(58) Field of Classification Search ..... 361/833, 361/835, 837; 439/620.26, 620.27, 620.29
See application file for complete search history.

(56) References Cited

U.S. PATENT DOCUMENTS

| | | | | |
|---|---|---|---|---|
| 480,802 | A | | 8/1892 | Blathy |
| 1,700,582 | A | | 1/1929 | Brown |
| 2,245,346 | A | | 6/1941 | Klein |
| 2,794,346 | A | | 6/1957 | Frost |
| 3,619,725 | A | | 11/1971 | Soden et al. |
| 3,638,157 | A | | 1/1972 | Kruzic |
| 3,671,808 | A | | 6/1972 | Martin |
| 3,775,723 | A | | 11/1973 | Mamrick et al. |
| 3,779,079 | A | | 12/1973 | Snook |
| 3,780,327 | A | | 12/1973 | Vervaart et al. |
| 3,909,767 | A | | 9/1975 | Williamson et al. |
| 3,913,219 | A | | 10/1975 | Lichtblau |
| 4,023,265 | A | | 5/1977 | Aryamane |
| 4,071,837 | A | | 1/1978 | Ranzanigo |
| 4,090,230 | A | | 5/1978 | Fuller et al. |
| 4,099,320 | A | | 7/1978 | Schmidt, Jr. et al. |
| 4,131,869 | A | | 12/1978 | Schmidt, Jr. et al. |
| 4,145,971 | A | | 3/1979 | Graham et al. |
| 4,149,216 | A | | 4/1979 | Kussy et al. |
| 4,164,725 | A | | 8/1979 | Wiebe |
| 4,198,744 | A | | 4/1980 | Nicolay |
| 4,221,455 | A | * | 9/1980 | Cairns et al. ..... 439/355 |
| 4,224,592 | A | | 9/1980 | Urani et al. |
| 4,278,706 | A | | 7/1981 | Barry |
| 4,349,861 | A | | 9/1982 | Zizza |
| 4,351,014 | A | | 9/1982 | Schofield, Jr. |
| 4,503,415 | A | | 3/1985 | Rooney et al. |
| 4,673,928 | A | | 6/1987 | Guim |
| 4,681,036 | A | | 7/1987 | Grobler |

(Continued)

FOREIGN PATENT DOCUMENTS

DE 44 13 847 11/1994

(Continued)

*Primary Examiner* — Dameon E Levi
(74) *Attorney, Agent, or Firm* — Kacvinsky Daisak PLLC

(57) ABSTRACT

A master fuse module includes a base housing configured to be disposed on a battery, a fuse assembly connected to the base housing, and a cover disposed on the base housing. The fuse assembly includes a first generally planar portion including a first terminal, a second generally planar portion disposed generally perpendicular to the first generally planar portion, a plurality of second terminals, and a plurality of fuses. Each fuse includes a first portion in electrical communication with the first terminal and a second portion in electrical communication with one of the plurality of second terminals. A fuse element is in electrical communication between the first and second portions and provides overcurrent protection by melting when subjected to a predetermined current. A plurality of connectors connects the fuse assembly to the base housing.

18 Claims, 11 Drawing Sheets

U.S. PATENT DOCUMENTS 4,769,295 A 9/1988 Kudo et al.
4,959,589 A 9/1990 Barakitis et al.
5,024,619 A 6/1991 Caraballo
5,244,756 A 9/1993 Mix et al.
5,389,462 A 2/1995 Lin
5,438,310 A * 8/1995 Ikari ..... 337/208
5,445,907 A 8/1995 Ito et al.
5,503,642 A 4/1996 Lippert et al.
5,588,883 A 12/1996 Hattori
5,643,693 A 7/1997 Hill et al.
5,645,448 A 7/1997 Hill
5,716,243 A 2/1998 Kourimsky
5,822,164 A 10/1998 Graf
5,886,611 A * 3/1999 Schaller et al. ..... 337/189
6,028,381 A 2/2000 Yumiyama et al.
6,211,578 B1 4/2001 Tamura
6,288,881 B1 9/2001 Melvin et al.
6,386,907 B1 5/2002 Ruffa
6,396,380 B1 5/2002 Girke et al.
6,528,899 B1 3/2003 Saito et al.
6,723,920 B2 * 4/2004 Higuchi et al. ..... 174/50
6,737,578 B2 * 5/2004 Higuchi ..... 174/50
6,927,953 B2 8/2005 Ikeda
6,934,164 B2 * 8/2005 Higuchi et al. ..... 361/833
6,948,982 B2 * 9/2005 Higuchi et al. ..... 439/620.26
7,034,643 B1 4/2006 Kusumoto et al.
7,046,115 B2 * 5/2006 Higuchi et al. ..... 337/193
7,067,934 B2 6/2006 Kitagawa et al.
7,129,410 B2 * 10/2006 Kanazawa ..... 174/50
7,172,462 B1 2/2007 Gronowicz, Jr.
7,233,474 B2 6/2007 Brown et al.
7,568,921 B2 * 8/2009 Pavlovic et al. ..... 439/76.2

FOREIGN PATENT DOCUMENTS

DE 44 30 284 3/2006

* cited by examiner

MASTER FUSE MODULE

BACKGROUND

The present disclosure relates, generally, to a fuse assembly. More particularly; it relates to a master fuse assembly providing several fuses in a single assembly that can be mounted on an automobile battery.

Fuses are used in automobiles to provide a fused connection between the battery and various components, such as the starter, generator, and so forth. The fuses may be provided in a fuse assembly that may be connected to the automobile battery. These assemblies typically include several different elements, multiple components, and multi-part housings that are expensive to make and assemble.

SUMMARY

In various aspects, the present disclosure includes a master fuse module with a base housing, a fuse assembly, and a cover. The incorporation of multiple fuses into one master fuse provides a master fuse module that is easy to assemble.

In one aspect, a master fuse module includes a base housing configured to be disposed on a battery, a fuse assembly connected to the base housing, and a cover disposed on the base housing. The fuse assembly includes a first generally planar portion including a first terminal, a second generally planar portion disposed generally perpendicular to the first generally planar portion, a plurality of second terminals, and a plurality of fuses. Each fuse includes a first portion in electrical communication with the first terminal and a second portion in electrical communication with one of the plurality of second terminals. A fuse element is in electrical communication between the first and second portions and provides overcurrent protection by melting when subjected to a predetermined current. A plurality of connectors connects the fuse assembly to the base housing. At least some of the plurality of connectors are disposed on the first portion and the second portion adjacent the fuse element of the at least one fuse. The cover is disposed on the base housing such that the fuse assembly is disposed between the cover and the base housing.

In another aspect, a method of making a master fuse module includes providing a base housing configured to be disposed on a battery. A metal sheet is formed into a pattern including a plurality of fuses. The metal sheet is bent to provide a first generally planar portion comprising a first terminal and a second generally planar portion disposed generally perpendicular to the first generally planar portion to provide a fuse assembly. The fuse assembly includes a plurality of second terminals and the plurality of fuses. Each fuse includes a first portion in electrical communication with the first terminal, a second portion in electrical communication with one of the plurality of second terminals, and a fuse element in electrical communication between the first and second portions. The fuse assembly is connected to the base housing with a plurality of connectors. At least some of the plurality of connectors are disposed on the first portion and the second portion adjacent the fuse element of the at least one fuse. A cover is attached to the base housing such that the fuse assembly is disposed between the cover and the base housing.

Additional features and advantages are described herein, and will be apparent from, the following Detailed Description and the figures.

DETAILED DESCRIPTION

The present disclosure is directed to a master fuse module. The master fuse module is particularly useful for automotive applications. The master fuse module incorporates multiple fuses into one master fuse assembly. The master fuse module is easier to assemble and requires fewer components than conventional systems and is easier to package and assemble.

Figure 1:
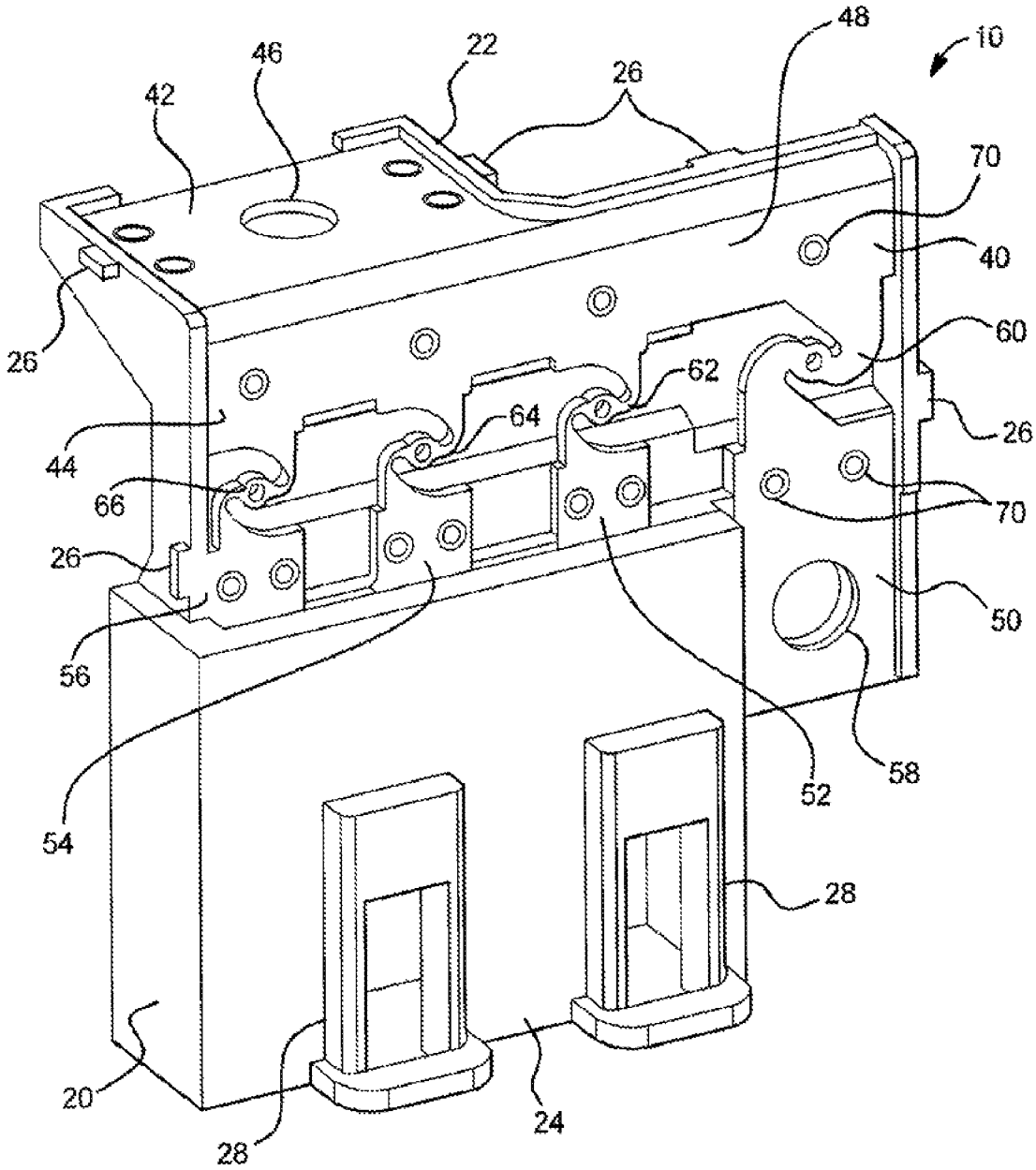
FIG. 1 is a perspective view of a first embodiment of a master fuse module of the present disclosure.
Figure 2:
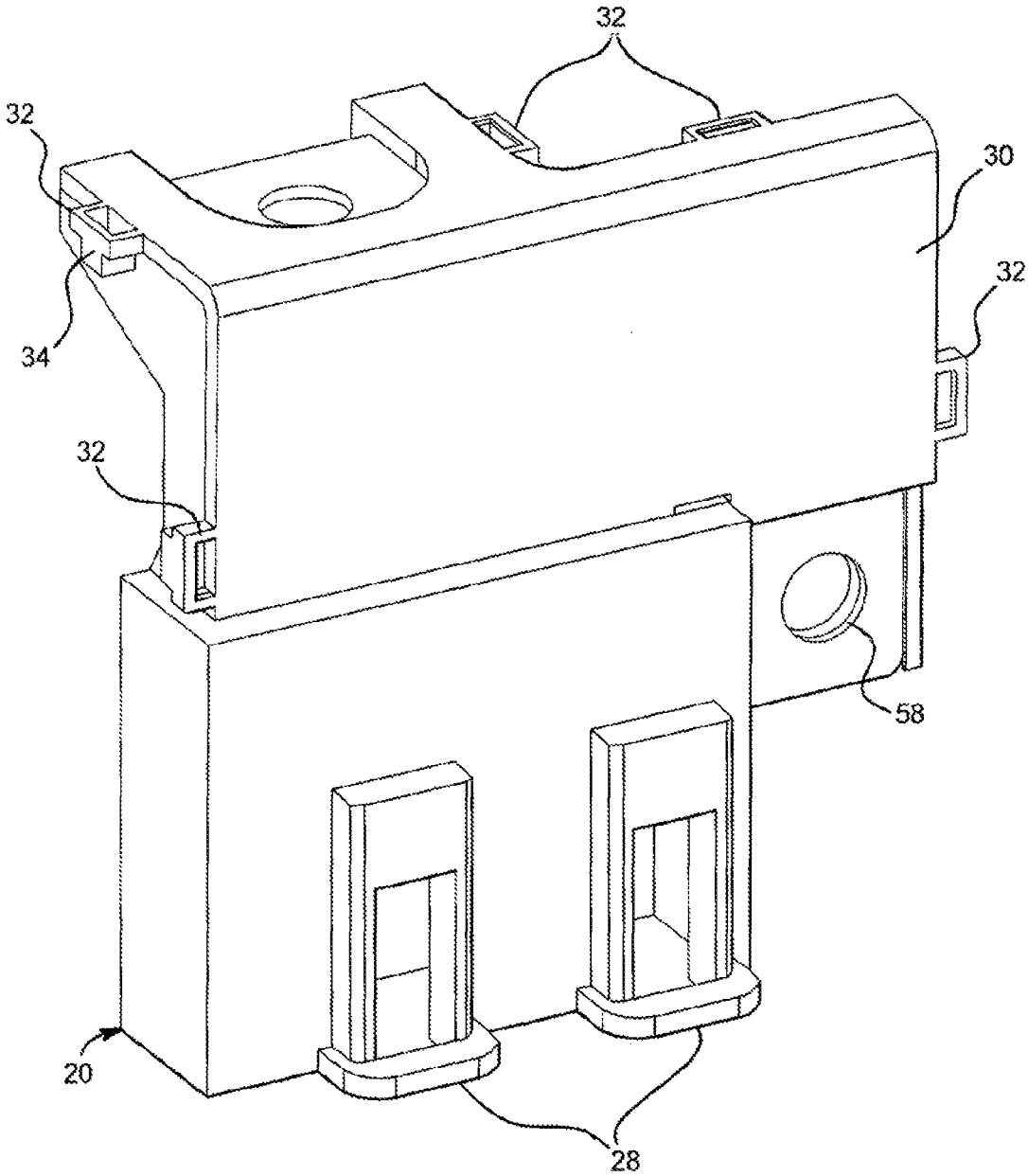
FIG. 2 is a perspective view of the master fuse module of FIG. 1 with a cover attached.

Referring now to FIG. 1, a first embodiment of a master fuse module 10 is shown. The master fuse module 10 provides a way for multiple fuses to be connected to a battery to provide a fused connection to multiple components. The master fuse module 10 includes a base housing 20, a fuse assembly 40, and a cover portion 30 (as seen in FIG. 2). The base housing 20 is configured to be disposed on a battery. The base housing 20 is composed of an insulating material, such as plastic. In one embodiment, the base housing 20 includes a first portion 22 configured to be disposed on a top portion of a battery and a second portion 24 configured to be disposed on a side portion of the battery. The first and second portions 22, 24 may be generally planar in shape to conform to the surface of the battery. The first and second portions 20, 22 may be disposed generally perpendicular to one another.

A fuse assembly 40 is connected to the base housing 20. The fuse assembly 40 is made of a conductive material and provides fuses and electrical connections between the battery and the elements powered by the battery. The fuse assembly 40 includes a first generally planar portion 42 and a second generally planar portion 44 disposed generally perpendicular to the first generally planar portion 42. The portion 42 includes an opening 46 configured for attachment to a battery clamp connected to a battery post. The first portion 42 includes a first terminal 48 configured for electrical connection with a battery. The first terminal 48 provides an electrical connection to all of the fuse elements. The fuse assembly 40 includes at least one second terminal 50. In general, there will be multiple second terminals 50, 52, 54, 56, each one corresponding to a fuse. At least one, and generally multiple, fuses 60, 62, 64, 66 are configured between the first terminal 48 and the second terminals 50, 52, 54, 56. At least some of the fuses 60, 62, 64, 66 may be arranged in a generally parallel arrangement, such that the elements of each fuse are, for example, of the same configuration and disposed the same distance from the common first terminal 48. The fuses 60, 62, 64, 66 may be integrally formed with the various elements of the fuse assembly 40. In one embodiment, the fuses 60, 62, 64, 66 are configured for electrical connection to various automobile components. The fuse assembly 40 may be composed of copper, tin-plated copper, or silver-plated copper.

In one embodiment, the fuse assembly 40 includes one higher-rated fuse 60 and two or more lower-rated fuses 62, 64, and 66. The fuses are rated for the appropriate amperage depending on the application. The higher-rated fuse 60 is generally for an element that draws a larger current, such as the alternator or generator of an automobile. The higher-rated fuse 60 may be rated above about 100A. For such a rating, a bolt-down connection is preferred. The lower-rated fuses 62, 64, 66 are for elements that draw less current, such as various fuse boxes (for example, UEC, IEC, or REC), PTC heaters, electrical power steering, and the like. The lower-rated fuses 62, 64, 66 maybe rated at about 30 to 150 amps, such as 80, 100, or 125 amps.

The fuses 60, 62, 64, 66 may be located on any portion of the fuse assembly portions 42, 44. In the embodiment shown in FIG. 1, all of the fuses 60, 62, 64, 66 are located on the vertical portion 44 of the fuse assembly 40. In other embodiments, one or more of the fuses may be located on the horizontal portion 42 of the fuse assembly 40. Generally, at least one fuse is disposed on the vertical portion 44. Although the fuse assembly 40 in FIG. 1 includes four fuses, the fuse assembly 40 may include more or less fuses depending on the desired application.

Figure 1A:
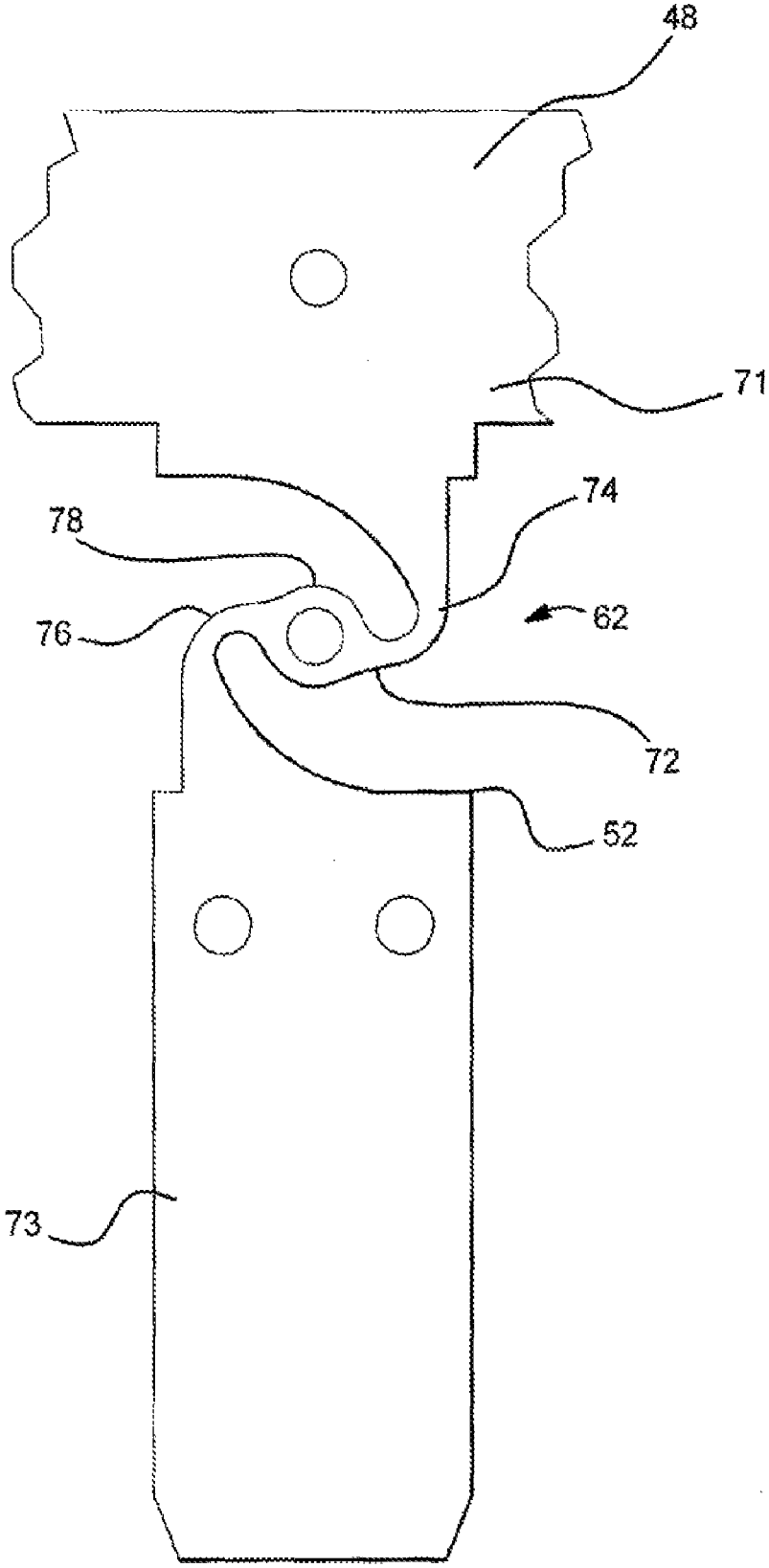
FIG. 1A is an enlarged view of a fuse of the of the master fuse module of FIG. 1.

Each fuse 60, 62, 64, 66 includes a portion in electrical communication with the first terminal 48 and a portion in electrical communication with one of the second terminals 50, 52, 54, 56. The fuse elements may be of any suitable design. An embodiment of a single fuse 62 is shown in FIG. 1A. A fuse element 72 is in electrical communication between terminal 48 and terminal 52. Portion 71 is in electrical communication with the first terminal 48 and portion 73 in electrical communication with second terminal 52. Fuse element 72 includes a pair of arms 74, 76 extending from the terminals 48, 52. Between the pair of arms 74, 76 and in electrical contact thereto is a disc 78 with an opening. The shape and thickness of the elements 74, 76, 78 is provided such that when a sufficient predetermined current flows through the fuse element 72, the element 72 melts and opens the circuit. The predetermined current of the fuse element 72 may be any suitable value.

As shown in FIG. 1, the fuse assembly 40 is connected to the base housing 20 with a plurality of connectors 70. Using fuse 62 as shown in FIG. 1A as an example, at least some of the connectors 70 are disposed on the first portion 71 and the second portion 73 of fuse 62 adjacent the fuse element 72. The location of the connectors 70 provides mechanical support for the fuses 60, 62, 64, 66, since they are relatively mechanically fragile due to the thinness of the fuse elements. The connector 70 may be disposed through holes in the base housing 20 and the fuse assembly 40. The connectors 70 allow the fuse assembly to be shaped with second portion 44 disposed generally perpendicular to the first portion 42. The placement of the connectors 70 reduces the stress on the fuses 60, 62, 64, 66. The connectors 70 may be rivets. Any type of conventional rivet may be used. The rivets may be any relatively inexpensive metal, and are preferably brass or steel. The use of connectors 70 provides for easier assembly and more mechanical strength than the use of plastic posts, and is more cost-effective than insert molding.

As shown in FIG. 2, a cover 30 is disposed on the base housing 20 such that the fuse assembly 40 is disposed between the cover 30 and the base housing 20. The cover 30 may be transparent. The cover 30 may be made from a suitable opaque or transparent plastic, such as nylon. The cover 30 is preferably not in substantial physical contact with the fuse assembly 40. If the cover 30 is not in contact with the fuse assembly 40, it will be subjected to lower temperatures and thus does not need to be made from a material with a high heat resistance. The cover 30 may be connected to the base housing 40 by any suitable method. In one embodiment, the cover 30 provides a snap-fit connection with the base housing 40. The cover 30 includes clip members 32. The clip members 32 include an extending portion 34 and may include a lip (not shown). The base housing 20 includes portions 26 that engage the clip members 32 to removably connect the cover 30 to the base housing 20. The cover 30 may be removably or permanently connected to the base housing 20. The cover 30 may be connected to the base housing 20 by other methods, such as fasteners, heat stakes, cold stakes, ultrasonic welding, adhesives, and other mechanical connections. If the cover 30 is transparent, it allows a user to monitor the status of the fuses, so that if a fuse element is "blown," it will be apparent without removing the cover 30.

Figure 3:
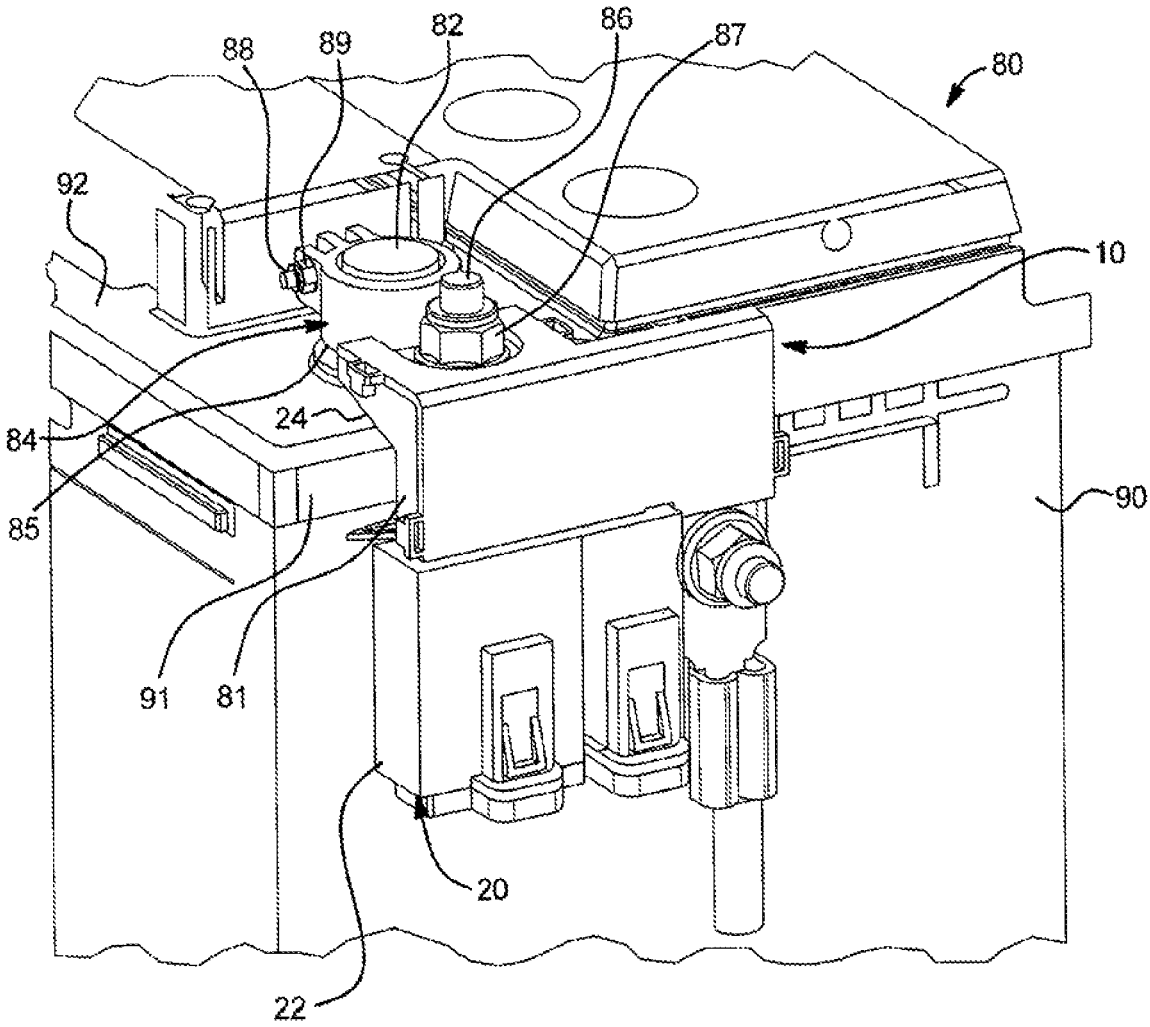
FIG. 3 is a perspective view of the master fuse module of FIG. 2 mounted on a battery.
Figure 4:
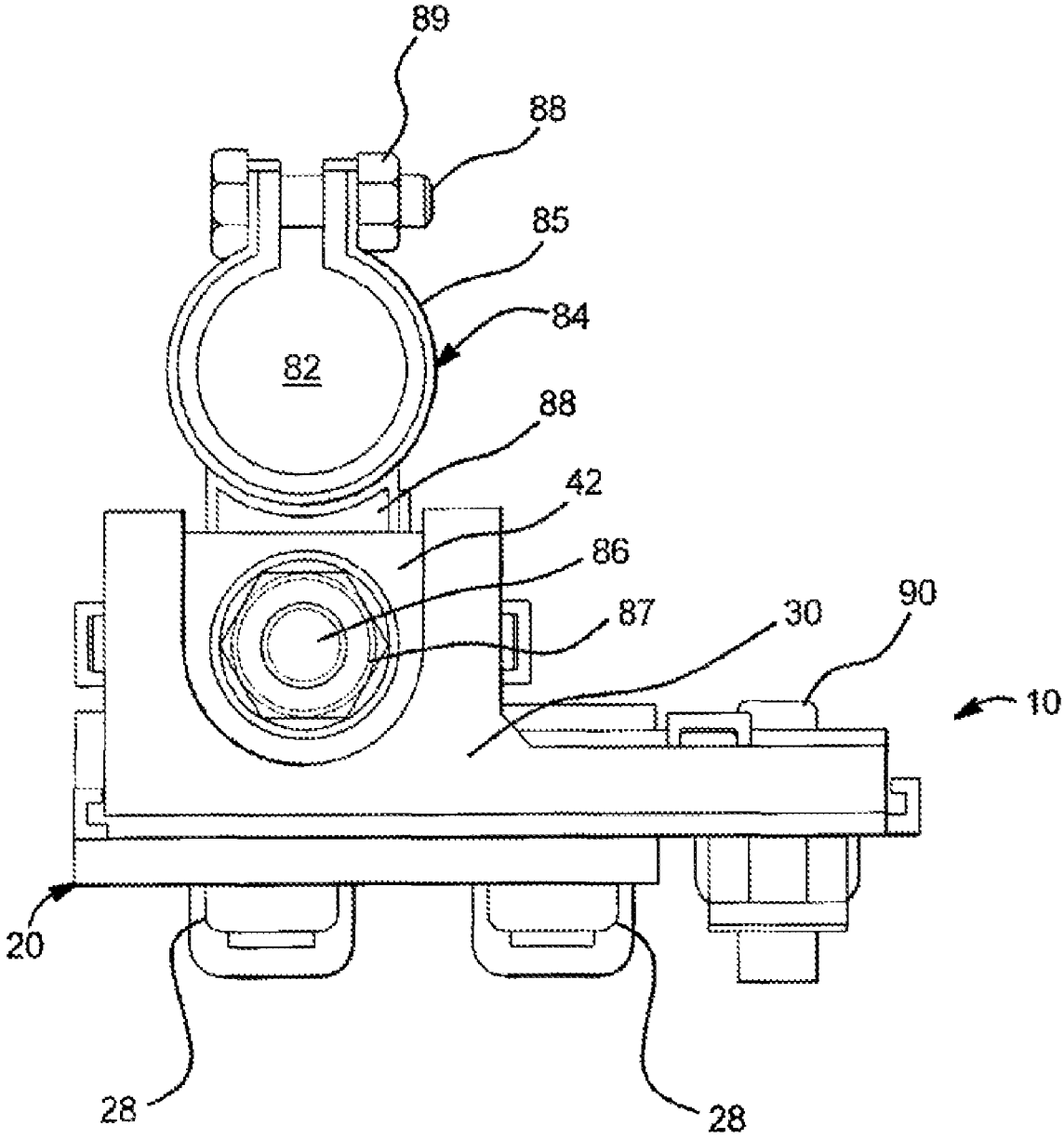
FIG. 4 is a top view of the master fuse module of FIG. 2.
Figure 5:
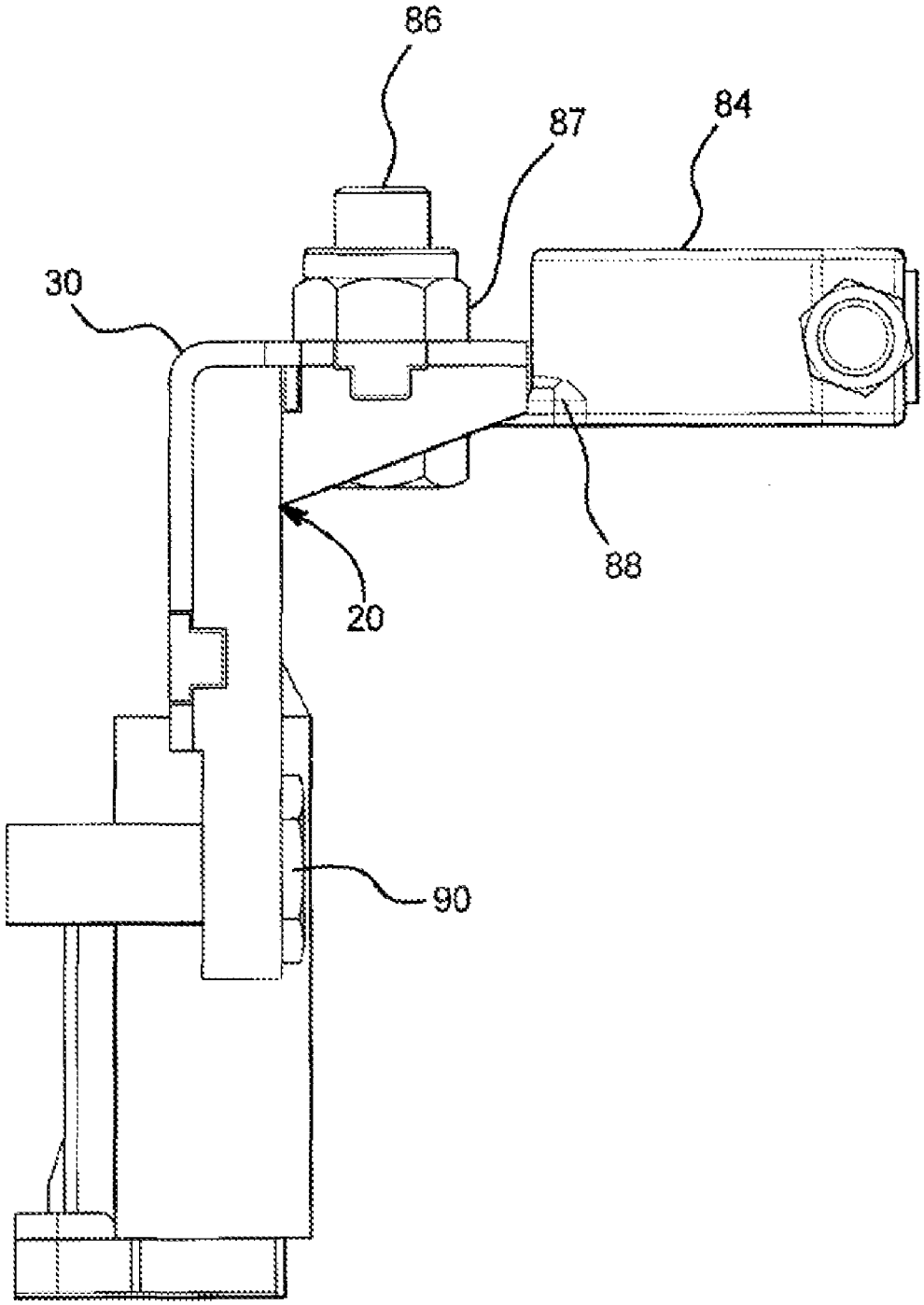
FIG. 5 is a side view of the master fuse module of FIG. 2.

FIG. 3 is a perspective view of the master fuse module 10 mounted on a battery 80. In one embodiment, the battery 80 is a conventional automobile battery. The battery 80 includes a terminal 82, a vertical wall 90, and a top portion 92. Base housing portion 22 is disposed on the top portion 92 of the battery 80 and base housing portion 24 is disposed adjacent the vertical wall 90 of the battery 80. The shape of base housing 20 may be configured to correspond to other features of battery 80 (such as ridges, channels, protrusions, and the like). For example, base housing 20 may include a concave section 81 on a top portion to accommodate a horizontal ridge 91 on the battery 80. The shape of the base housing 20 may depend on the mounting points and location of mating terminals and connectors and on the vehicle architecture and routing of the wiring harness. The master fuse module 10 may be directly coupled to the battery terminal 82. In the embodiment shown in FIG. 3, and also seen in FIG. 4, a battery clamp 84 is used to electrically and mechanically connect the master fuse module 10 to the battery 80. The battery clamp 84 includes a sleeve 85 disposed around the terminal 82. Sleeve 85 may be tightened by a fastener such as bolt 88 and nut 89. A bolt 86 extends through hole 46 to connect the battery clamp 84 to the master fuse module 10. A portion 88 connects sleeve 85 to bolt 86. A side view of the master fuse module 10 and battery clamp 84 is shown in FIG. 5. Bolt 90 extends through hole 58 to allow connection to fuse 60. Although a particular design of a battery clamp 84 is shown, the master fuse module 10 may be used with other types of battery clamps. The base housing 20 may include connection points 28 for providing connection the terminals (such as terminals 52, 54, and 56). These connection points may be configured to provide a connection to a female terminal plug-in style connection system.

Figure 6:
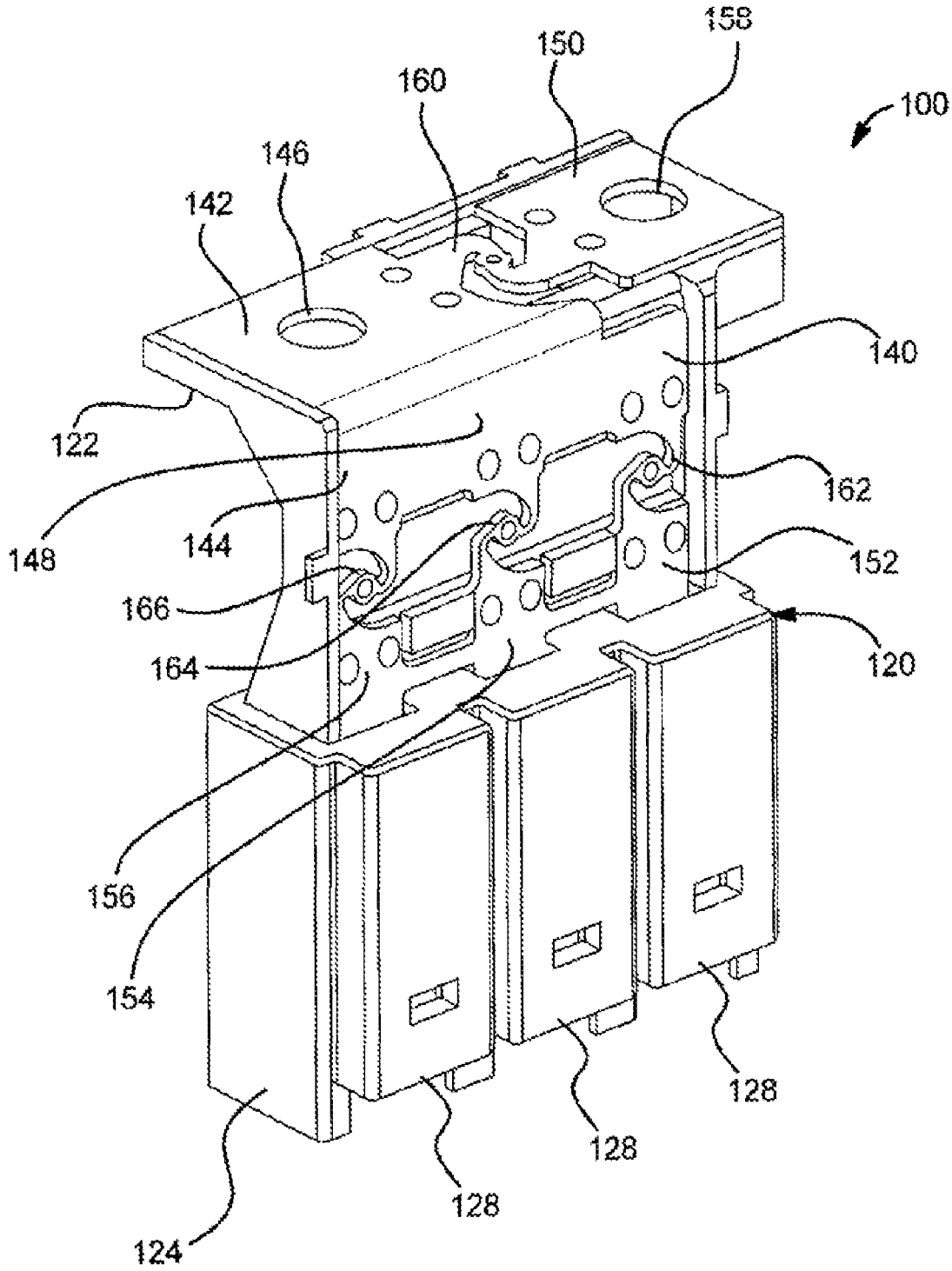
FIG. 6 is a perspective view of a second embodiment of a master fuse module of the present disclosure.
Figure 7:
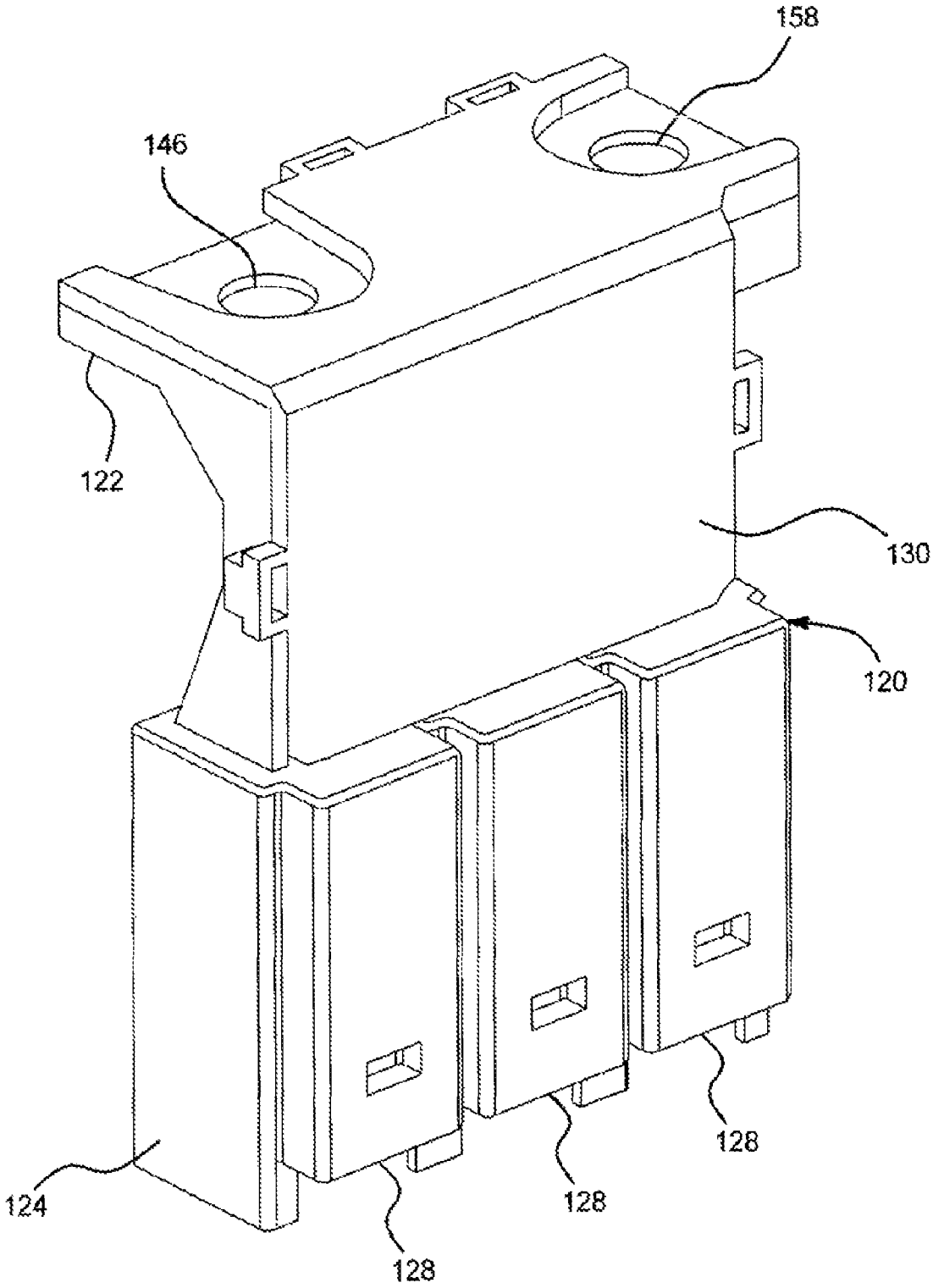
FIG. 7 is a perspective view of the master fuse module of FIG. 6 with a cover attached.

FIG. 6 shows a second embodiment 100 of a master fuse module. The master fuse module 100 is in most ways similar to the previously described embodiment 10, but differs in the location and configuration of the fuses. The master fuse module 100 includes a base housing 120, a fuse assembly 140, and a cover portion 130 (as seen in FIG. 7). The base housing 120 includes a first portion 122 configured to be disposed on a top portion of a battery and a second portion 124 configured to be disposed on a side portion of the battery. A fuse assembly 140 is connected to the base housing 120. The fuse assembly 140 includes a first generally planar portion 142 and a second generally planar portion 144 disposed generally perpendicular to the first generally planar portion 142. The first portion 142 includes an opening 146 configured for attachment to a battery clamp. The first portion 142 includes a first terminal 148. Master fuse module 100 includes second terminals 150, 152, 154, 156, corresponding to fuses 160, 162, 164, and 166, with the fuses 160, 162, 164, and 166 configured between the first terminal 148 and the respective second terminals 150, 152, 154, 156.

The fuse assembly 140 includes one higher-rated fuse 160 and lower-rated fuses 162, 164, and 166. In the embodiment shown in FIG. 6, three fuses are located on the vertical portion 144 of the fuse assembly 140, and a single fuse 160 is located on the horizontal portion 142 of the fuse assembly 140. The design of master fuse 100 allows for all bolt connections be provided at a top portion of the device, which may provide for easier assembly. Master fuse module 100 may include connectors 126 which provide electrical connection from fuses 162, 164, and 166. As shown in FIG. 7, master fuse module may include a cover 130. In other respects, master fuse module 100 is generally similar to master fuse module 10.

Figure 8:
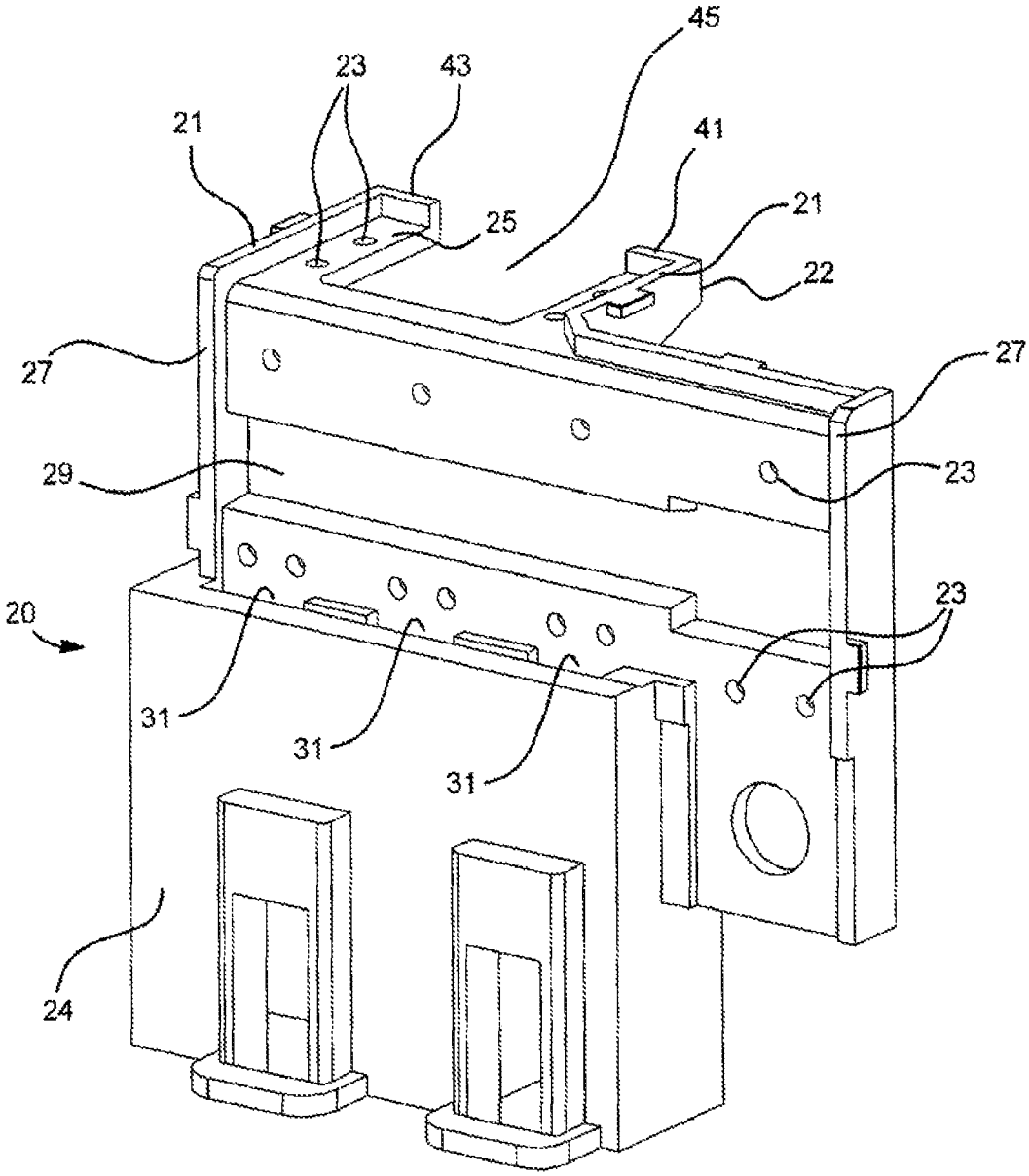
FIG. 8 is a perspective view of the housing of the master fuse module of FIG. 1.

The housings 20, 120 and fuse assemblies 40, 140 may be prepared using conventional techniques. The base housing 20 may be molded or cast from plastic. Suitable plastics may include, for example, polyphthalamide, high temperature nylon, and other high temp polymers. As shown in FIG. 8, the base housing may include holes 23 for attachment of fasteners 70. The base housing 20 may include peripheral ridges 21, 27 around portions 22, 24 respectively. The peripheral ridges 21, 27 provide a boundary for the fuse assembly 40. The base housing 20 may include a fuse cavity 29 configured behind the fuse area to provide a clear area behind the fuses. Slots 31 are provided for blades 53, 55, 57 of the fuse assembly 40. Housing portion 22 includes arms 41, 43 defining an opening 45 and configured to support fuse assembly portion 42 and provide clearance for opening 46 of the fuse assembly 40.

Figure 9:
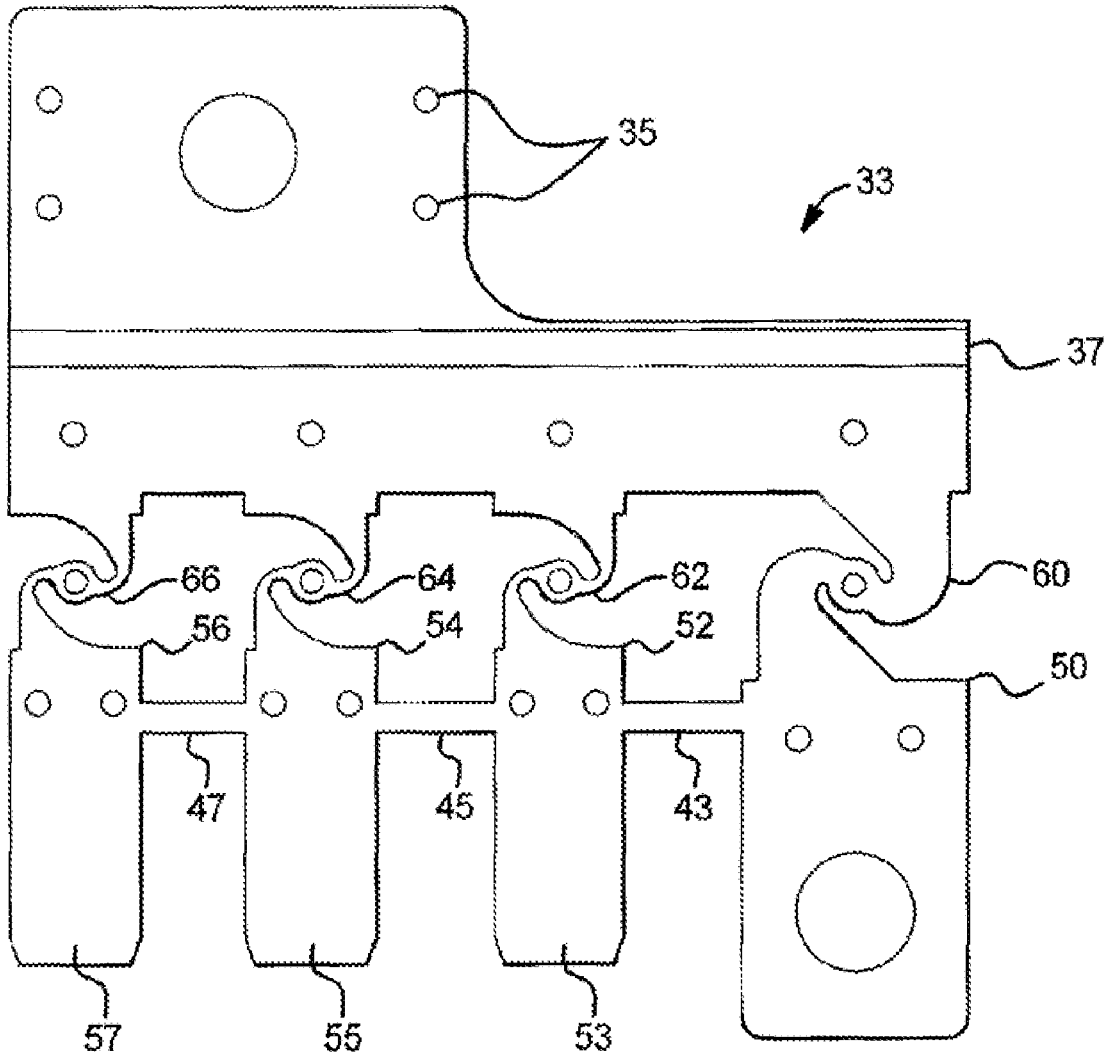
FIG. 9 is a top view of a fuse assembly during fabrication.
Figure 10:
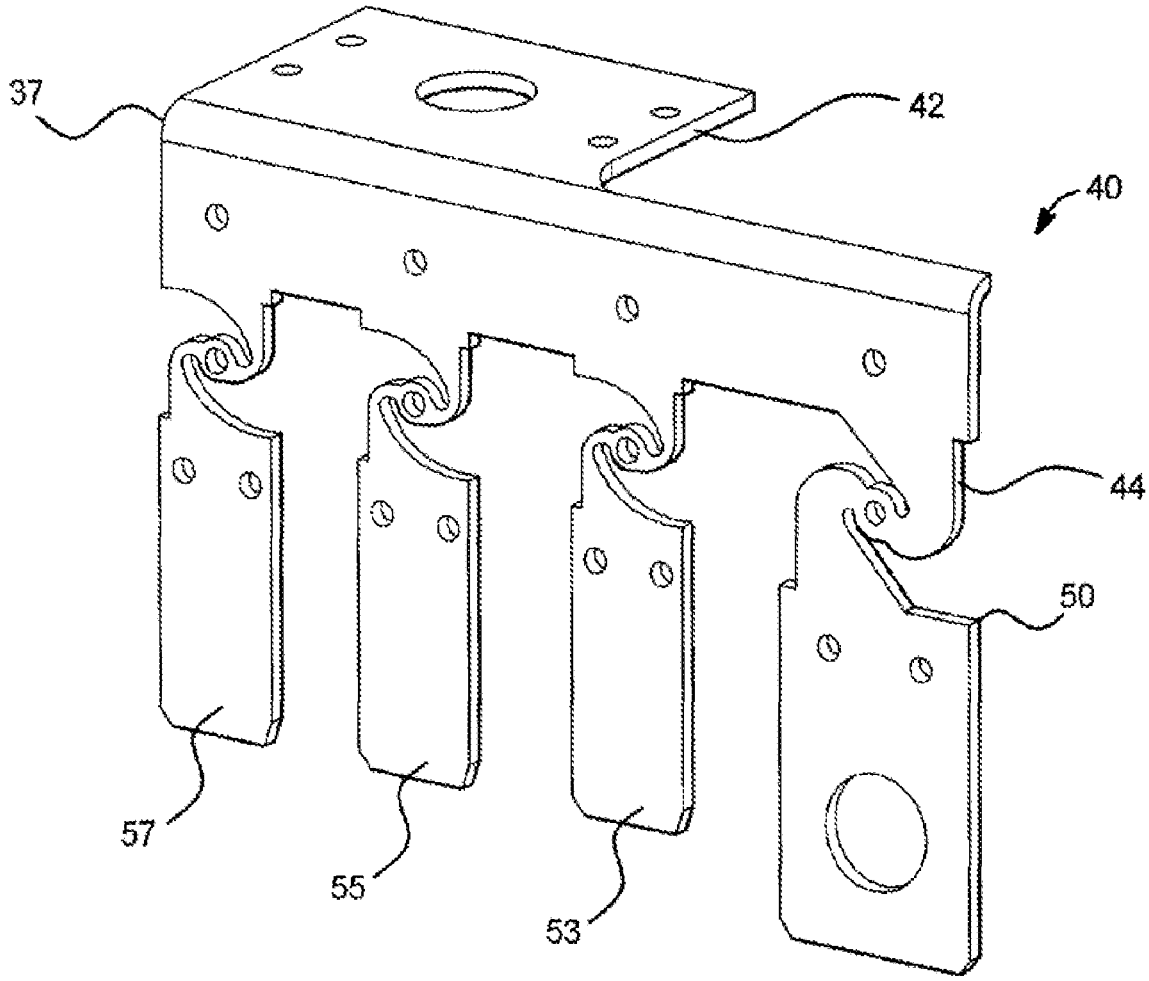
FIG. 10 is a perspective view of the fuse assembly of FIG. 9 after bending.

The fuse assembly 40 may be manufactured by any suitable method. In one embodiment, the fuse assembly 40 is formed from a flat metal sheet. The pattern of the fuses may be stamped or otherwise formed into the metal sheet, which is typically copper or a copper alloy. FIG. 9 shows a sheet 33 with fuse pattern stamped into it. Holes 35 may also be stamped or otherwise formed into the sheet 33. Rails 43, 45, and 47 may be provided in sheet 33 between terminals 50, 52, 54, 56 to provide support for the fuse assembly 40 until it is connected to the base housing 20, due to the structural fragility around the fuses 60, 62, 64, 66. Rails 43, 45, and 47 are later removed during the assembly of the master fuse module 10. Sheet 33 may be bent before or after stamping to form the fuse assembly 40. The sheet 33 is bent at 90° angle along line 37 to form first and second generally planar surfaces 42, 44 of fuse assembly 40, as shown in FIG. 9. The rails 43, 45, and 47 may be removed from the fuse assembly 40 after bending. The fuse assembly 40 is then attached to base housing 20 with fasteners 70. Blades 53, 55, 57 are disposed in slots 31. The fasteners 70 may be rivets that are connected by conventional riveting techniques through holes 35 in the fuse assembly 40 and holes 23 in base housing 20. Cover 30 is then snap-fit onto base housing 20 to provide a master fuse module 10 for connection to a suitable battery such as an automobile battery.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A master fuse module comprising:

a base housing configured to be disposed on a battery;

a fuse assembly connected to the base housing, comprising:

a first generally planar portion comprising a first terminal;

a second generally planar portion disposed generally perpendicular to the first generally planar portion;

a plurality of second terminals;

a plurality of fuses, each fuse comprising:

a first portion in electrical communication with the first terminal;

a second portion in electrical communication with one of the plurality of second terminals; and a fuse element in electrical communication between the first and second portions and providing overcurrent protection by melting when subjected to a predetermined current;

a plurality of connectors connecting the fuse assembly to the base housing, wherein at least some of the plurality of connectors are disposed on the first portion and the second portion adjacent the fuse element of the at least one fuse; and a cover disposed on the base housing such that the fuse assembly is disposed between the cover and the base housing.

2. The master fuse module of claim 1 wherein the cover is transparent.

3. The master fuse module of claim 1 wherein the cover is not in substantial physical contact with the fuse assembly.

4. The master fuse module of claim 1 wherein the cover provides a snap-fit connection with the base housing.

5. The master fuse module of claim 1 wherein the fuses are integrally formed with the fuse assembly.

6. The master fuse module of claim 1 wherein the plurality of connectors comprises a plurality of rivets, wherein the rivets are disposed through holes in the base housing and the fuse assembly.

7. The master fuse module of claim 1 wherein the first generally planar portion comprises an opening configured for connection to the terminal post of a battery.

8. The master fuse module of claim 1 wherein the fuse assembly is composed of a metal selected from copper, tin plated copper, silver plated copper, copper alloys, zinc, and mixtures thereof.

9. The master fuse module of claim 1 further comprising at least one connector for providing mechanical and electrical connection from at least one of the plurality of second terminals.

10. The master fuse module of claim 1 wherein the plurality of fuses comprises at least three fuses.

11. The master fuse module of claim 10 wherein at least one of the fuses is configured for electrical connection to a high current circuit of an automobile.

12. The master fuse module of claim 1 wherein at least one of the plurality of fuses is disposed on the second generally planar portion.

13. A master fuse module comprising:

a base housing configured to be disposed on an automobile battery;

a fuse assembly connected to the base housing, comprising:

a first generally planar portion comprising a first terminal, the first generally planar portion configured to be disposed on a top portion of the automobile battery;

a second generally planar portion disposed generally perpendicular to the first generally planar portion, the second generally planar portion configured to be disposed adjacent a side portion of the automobile battery;

a second terminal;

a fuse comprising:

a first portion in electrical communication with the first terminal;

a second portion in electrical communication with the second terminal; and a fuse element in electrical communication between the first and second portions and providing overcurrent protection by melting when subjected to a predetermined current;

a plurality of connectors connecting the fuse assembly to the base housing, wherein at least some of the plurality of connectors are disposed on the first portion and the second portion adjacent the fuse element of the fuses; and a cover disposed on the base housing such that the fuse assembly is disposed between the cover and the base housing, wherein the cover is not in substantial physical contact with the fuse assembly.

14. The master fuse module of claim 13 wherein the fuse is integrally formed with the fuse assembly.

15. The master fuse module of claim 13 wherein the fuse is disposed on the second generally planar portion.

16. A method of making a master fuse module, comprising:

providing a base housing configured to be disposed on a battery;

providing a metal sheet;

forming the metal sheet into a pattern including a plurality of fuses;

bending the metal sheet to provide a first generally planar portion comprising a first terminal and a second generally planar portion disposed generally perpendicular to the first generally planar portion to provide a fuse assembly comprising:

a plurality of second terminals;

the plurality of fuses, each fuse comprising:

a first portion in electrical communication with the first terminal;

a second portion in electrical communication with one of the plurality of second terminals; and a fuse element in electrical communication between the first and second portions;

connecting the fuse assembly to the base housing with a plurality of connectors, wherein at least some of the plurality of connectors are disposed on the first portion and the second portion adjacent the fuse element of the at least one fuse; and attaching a cover to the base housing such that the fuse assembly is disposed between the cover and the base housing.

17. The method of claim 16 wherein connecting the fuse assembly to the base housing with a plurality of connectors comprises riveting the fuse assembly to the base housing.

18. The method of claim 16 wherein the pattern of the metal sheet includes a plurality of rails extending between the fuses, farther comprising removing the rails before attaching the cover to the base housing.

* * * * *